US005279219A

United States Patent [19]

Hoffa

[11] Patent Number: 5,279,219

[45] Date of Patent: Jan. 18, 1994

[54] MARKING APPARATUS

[75] Inventor: Jack L. Hoffa, Brea, Calif.

[73] Assignee: Eubanks Engineering Co., Monrovia, Calif.

[21] Appl. No.: 981,529

[22] Filed: Nov. 25, 1992

[51] Int. Cl.[5] ..... B41J 1/60

[52] U.S. Cl. ..... 101/99; 101/110; 101/43; 101/93.21; 101/100

[58] Field of Search ..... 101/18, 42, 43, 57, 101/59, 79, 91, 92, 93.18, 93, 93.21, 93.24, 93.28, 94, 99, 102, 110, 100

[56] References Cited

U.S. PATENT DOCUMENTS

| | | | |
|---|---|---|---|
| 1,188,828 | 6/1916 | Putnam et al. | 101/110 |
| 2,777,385 | 1/1957 | Bachy | 101/42 |
| 3,015,265 | 1/1962 | Gmeiner | 101/93.21 |
| 4,448,122 | 5/1984 | Holland-Letz | 101/91 |
| 4,485,735 | 12/1984 | Jonca | 101/93.21 |
| 4,864,924 | 9/1989 | Storace | 101/110 |
| 4,967,654 | 11/1990 | Strong et al. | 101/18 |
| 5,168,804 | 12/1992 | Lee et al. | 101/99 |

FOREIGN PATENT DOCUMENTS

| | | | |
|---|---|---|---|
| 0227053 | 10/1986 | Japan | 101/110 |

*Primary Examiner*—Edgar S. Burr
*Assistant Examiner*—Christopher A. Bennett
*Attorney, Agent, or Firm*—William W. Haefliger

[57] ABSTRACT

A printing apparatus having a printing head comprising a plurality of coaxial, rotatable printing wheels, disposed substantially side-by-side and employing printing characters, and a control rotor for controlling the printing wheels and having its axis parallel to that of the printing wheels and positioned to be moved bi-directional to come into engagement with any selected printing wheel and then to be rotated about its axis to rotate the selected printing wheel for bringing into printing position a desired character thereon, comprising mounting structure mounting the control rotor to i) move axially parallel to the axis of the printing wheels, ii) move toward and away from the axis of the printing wheels, iii) rotate as aforesaid; and drive structure to effect the i) movement, the ii) movement and the iii) rotation.

18 Claims, 5 Drawing Sheets 22b
22a
22
10
10a
10b
12
13
14
19
19a
20
21
22
47
47a
54
56
57
58
59
70
110
112
113
114
120
121
122
123
124
130
131
132
133
134
135
140

MARKING APPARATUS

BACKGROUND OF THE INVENTION

This invention relates generally to apparatus to print a sequence of selected alphanumeric or other characters on work, as for example, wires, and more particularly relates to improvements in such devices.

U.S. Pat. No. 4,485,735 discloses a device capable of printing selected characters on a wire. It incorporates a control wheel that selectively and sequentially rotates printing wheels in a stack.

There is need for improved devices capable of such operation, and wherein interference between the control wheel and print wheels is avoided, as during shifting of the control wheel between printing wheels, to be rotated. There is also need for highly efficient, easily controllable, and rapidly programmable and operable apparatus of this general type.

SUMMARY OF THE INVENTION

It is a major object of the invention to provide improved apparatus meeting the above needs. Basically, the apparatus has a plurality of coaxial, rotatable printing wheels, disposed substantially side-by-side and employing printing characters, and a control rotor for controlling the printing wheels and having its axis parallel to that of the printing wheels and positioned to be moved bi-directionally to come into engagement with any selected printing wheel and then to be rotated about its own axis to rotate the selected printing wheel for bringing into printing position a desired character thereon.

In this environment, the apparatus of the invention includes:

a) mounting means mounting the control rotor to i) move axially parallel to the axis of the printing wheels, ii) move toward and away from the axis of the printing wheels, iii) rotate as aforesaid, b) and drive means to effect the i) movement, the ii) movement and the iii) rotation.

It is another object to provide lock bar means controllably movable axially parallel to the axis of the printing wheels for locking all but the selected printing wheel against rotation. As will be seen, the lock bar means preferably has a notch presentable toward the selected printing wheel for passing the periphery of the selected wheel during its rotation by the control rotor. The lock bar means is typically movable simultaneously with the control rotor axially parallel to the axis of the printing wheels.

A further object includes the provision of means to feed a wire generally parallel to the axis of the printing wheels and into proximity to the peripheries of the printing wheels at which the printing characters are located, means to feed a printing media between the wire and the printing wheels, and clamping means operable to displace the wire relative to the printing wheels to clamp the printing media between the wire and selected characters on the printing wheels, thereby to print representations of the selected characters on the wire. Such feed means advantageously includes a media feed drum, a media take-up drum, and mechanism operable in response to cycling operation of the clamping means to interruptedly rotate the take-up drum.

A further object includes the provision of mounting means that includes a carriage for the control wheel, there being a frame mounting the carriage for movement axially parallel to the axis of the printing wheels, and the mounting means includes a pusher on the carriage to push the control rotor toward a first position of engagement with the periphery of a printing wheel selected for rotation by the control rotor, and subsequent movement away from the selected wheel periphery to a second position free of disengagement with the print wheel periphery, to allow the control rotor movement parallel to the axis of the printing wheels, without interference with the latter. Stop means is provided on the carriage to block rotation of the control rotor when the control rotor is in its second position.

Yet another object includes the provision of printing wheels that have peripheral teeth thereon spaced circumferentially about the axis of the printing wheels, the control rotor having teeth thereon spaced circumferentially about the control rotor axis, the control rotor teeth meshing with the teeth on a selected printing wheel during control rotor rotation it in first position, and the control rotor teeth being out of driving mesh with teeth on all printing wheels when the control rotor is in its second position, the stop means extending between successive teeth on the control rotor in the second position thereof.

Another object includes the provision of a non-rotatable homing wheel associated with and coaxial with the printing wheels and positioned such that when the control rotor is moved into radial homing alignment with the homing wheel, the lock bar means locks all of the printing wheels against rotation, achieving a known "zeroed" state.

An additional object includes the provision of means controlling the drive means that effects rotation of the control rotor to controllably effect its rotation through limited angles in opposite directions in relation to homing wheel teeth, thereby to accurately position the control rotor teeth relative to the teeth on the homing rotor, to initially and accurately position the control rotor relative to the printing wheels, prior to rotation of the selected printing wheel by the control rotor to position a selected character on the printing wheel for printing. Drivers for control rotor rotation and axial movement advantageously include first and second motors with associated encoders connected in feedback relation with a programmable computer that controls the motors. Programming allows selection of characters on the print wheels, to be presented for printing.

These and other objects and advantages of the invention, as well as the details of an illustrative embodiment, will be more fully understood from the following specification and drawings, in which:

DRAWING DESCRIPTION

Figure 1:
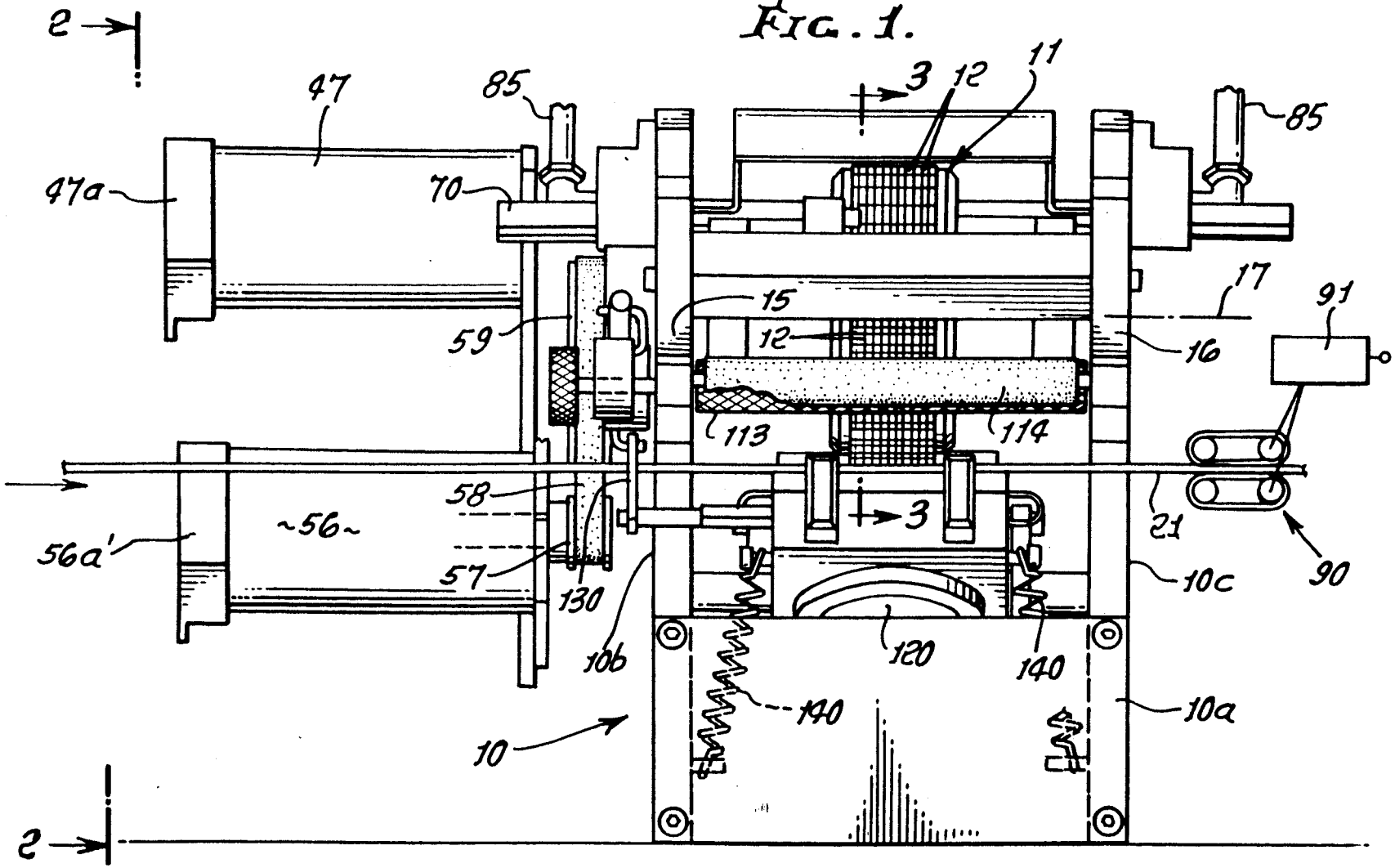
FIG. 1 is a front elevation showing apparatus incorporating the invention.
Figures 2, 2A:
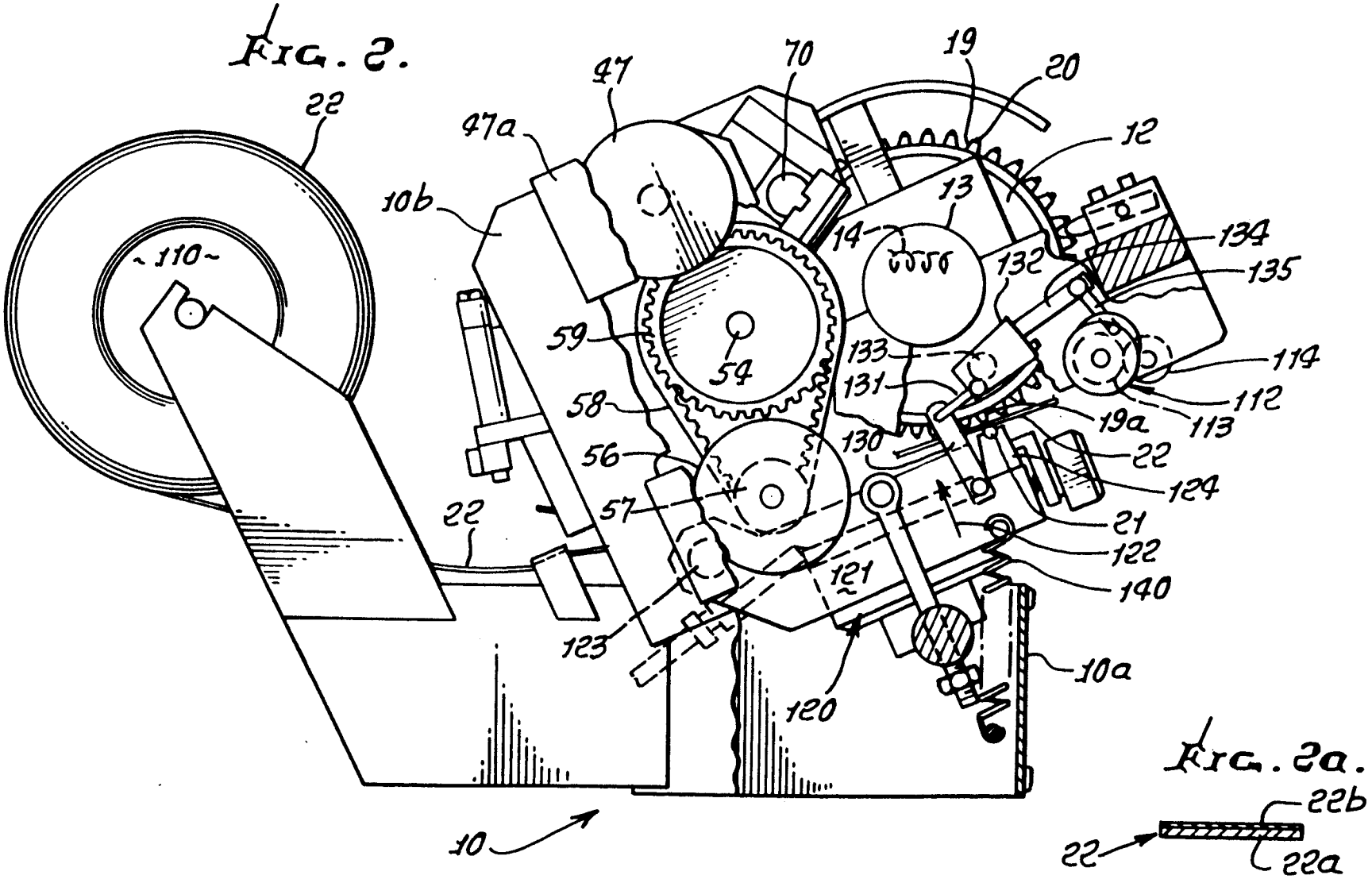
FIG. 2 is an end elevation taken on lines 2—2 of FIG. 1.
Figure 3:
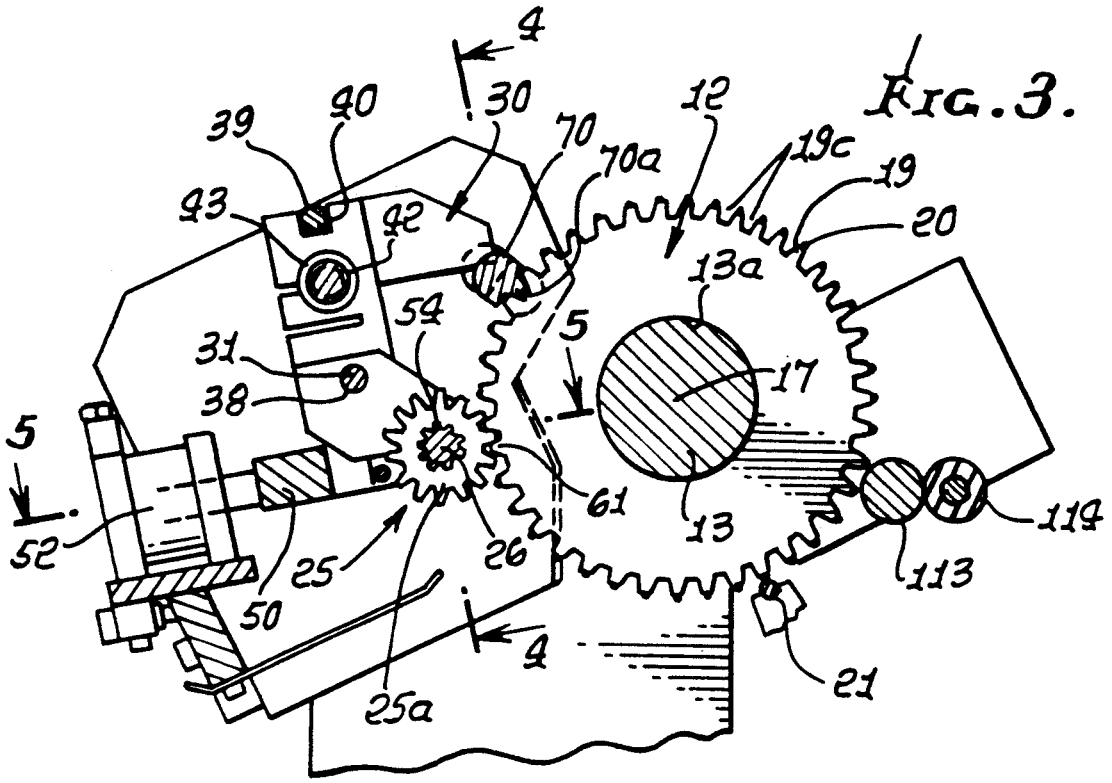
Figure 4:
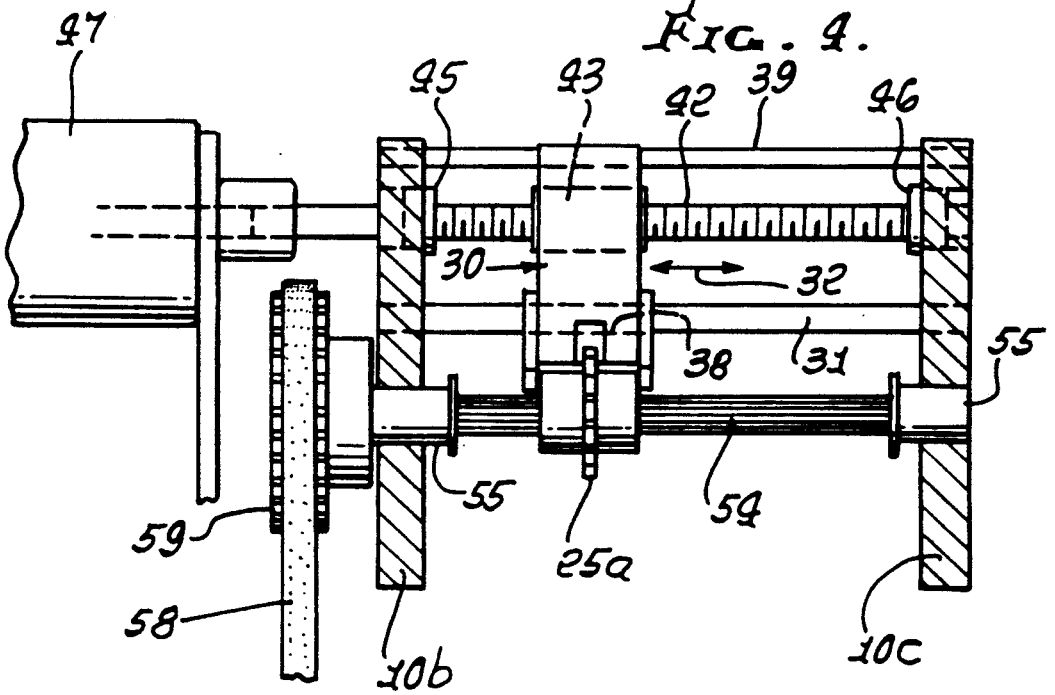
Figure 5:
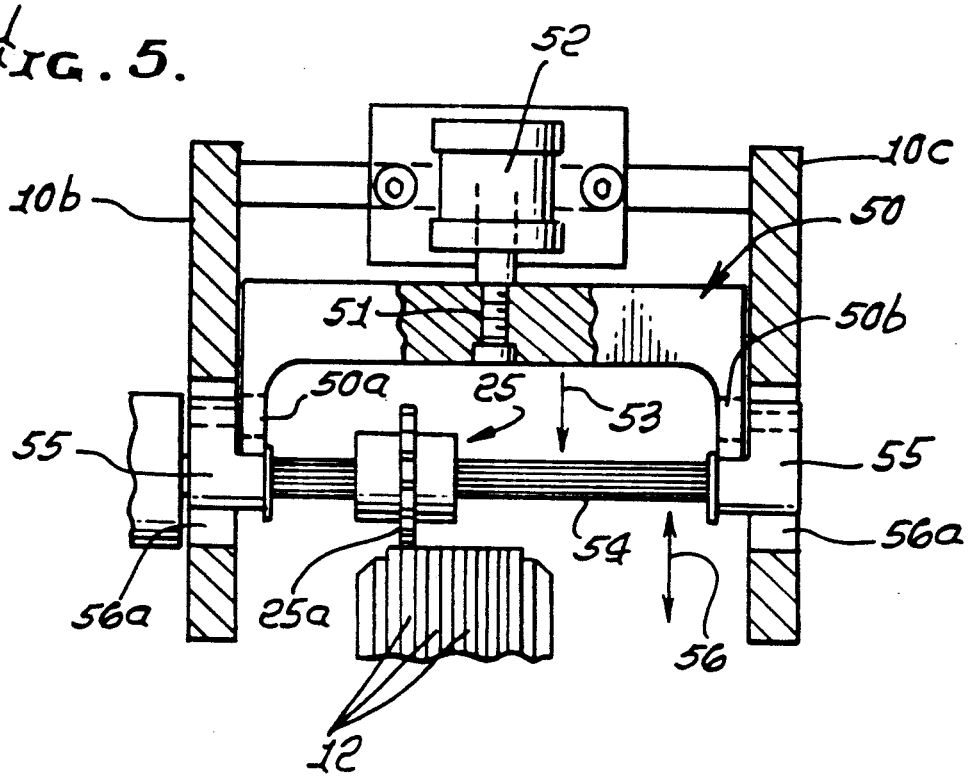
Figure 6:
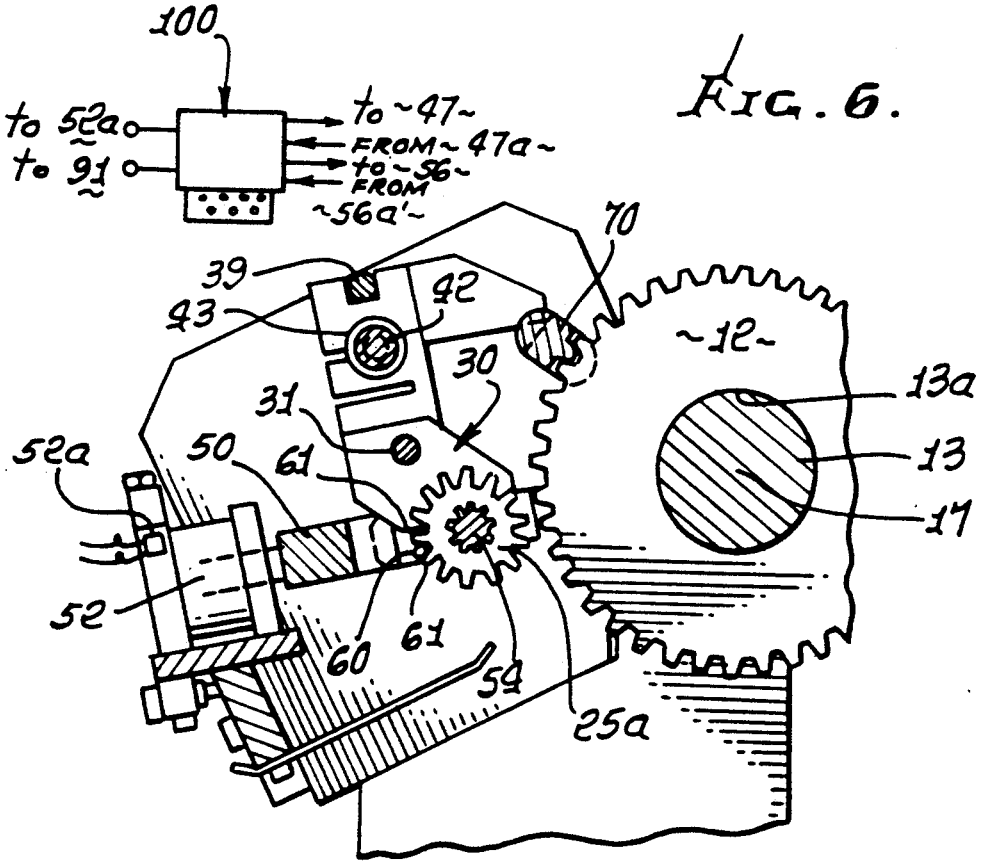
Figure 7:
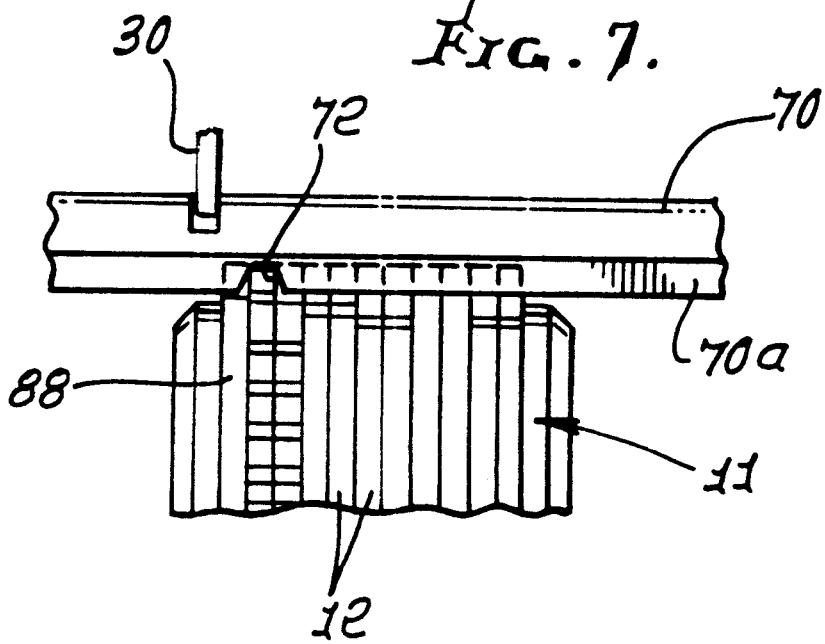
Figure 8:
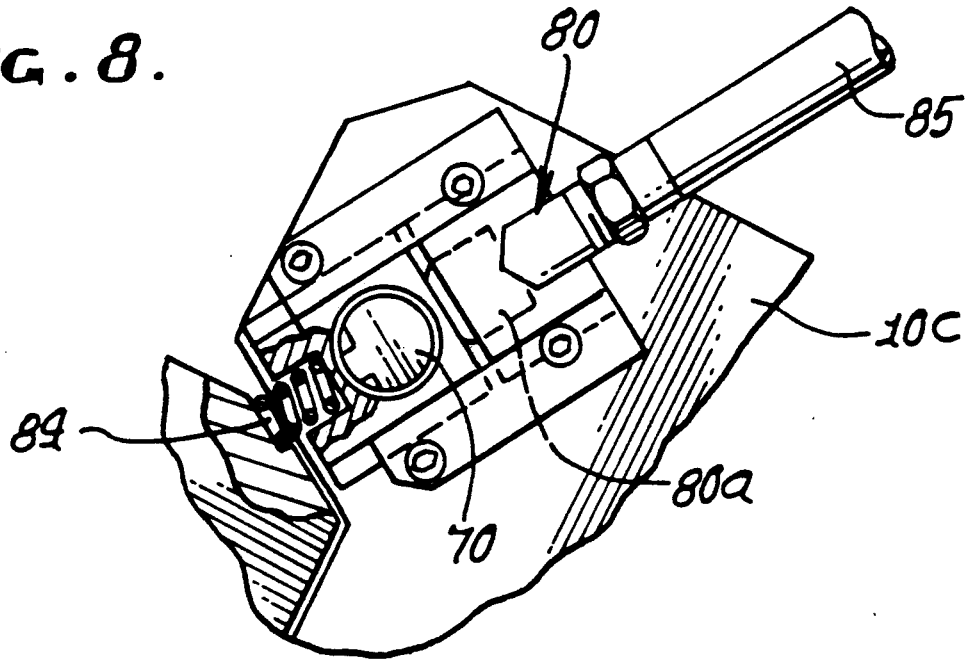

FIG. 2*a* is an enlarged section showing a print medium;

FIG. 3 is an elevation taken in section on lines 3—3 of FIG. 1, showing a control rotor advanced to engage or mesh with a printing wheel;

FIG. 4 is a section taken on lines 4—4 of FIG. 3;

FIG. 5 is a section taken on lines 5-5 of FIG. 3;

FIG. 6 is a view like FIG. 3 but showing the toothed control rotor retracted relative to a printing wheel;

FIG. 7 is a fragmentary view showing positioning of the control rotor and lock bar means, relative to a selected print wheel; and FIG. 8 is a section showing mechanism to push the lock bar into firm locking position as respects print wheels.

DETAILED DESCRIPTION

In the drawings, a frame 10 includes a base 10*a*, and laterally spaced upright members 10*b* and 10*c*. A print head 11 on the frame includes a plurality of coaxial, rotatable printing wheels or discs 12 disposed substantially side-by-side in a lateral stack. The wheels have bores 13*a* rotatably mounted on a fixed drum or tube 13, which is typically heated. See heater coil schematically indicated at 14 in FIG. 2. The drum or tube has its opposite ends supported at 15 and 16 on members 10*b* and 10*c*. The lateral axis of the print wheels appears at 17. The wheels carry peripheral teeth 19, with alphanumeric or other print characters 20 on the tips of the teeth. The print wheels are to be successively rotated by controlled angular amounts to bring a row of print characters into print position (see tooth 19*a* in FIG. 2) facing work, such as a wire 21 to be printed along its length, as via a print medium 22 in the form of a strip of material fed between the characters. That print medium may include synthetic resin strip 22*a* (see FIG. 2*a*) with printing ink 22*b* thereon, facing the wire, the ink upon being heated via the hot print wheel, depositing on the wire in conformance with the shape or form of the print characters 20 pressed against the strip 22*a*. The strip may consist of cellophane or polyester, for example.

Also provided is a control rotor 25 for controlling the rotation of the print wheels, and having its axis 26 of rotation parallel to the print wheel axis 17 of rotation. The rotor 25 is typically carried to be moved bi-directionally to come into engagement with any selected print wheel, and then to be rotated about its axis 26 to rotate the selected print wheel for bringing a desired character into printing position, as referred to. In this regard, and in accordance with the invention, mounting means is provided to mount the control wheel to:

i) move axially parallel to the axis of the printing wheels, ii) move toward and away from the axis of the printing wheels, iii) rotate as aforesaid.

In addition, drive means is provided to effect the above i) and ii) bi-directional movements of the control rotor, as well as its iii) rotation, to rotate the selected print wheel, as referred to.

The mounting means is shown in FIGS. 3 and 4 to include a carriage 30 for the control rotor, the carriage mounted by the frame, including a guide bar 31, for movement axially parallel (see arrows 32) to the axis 17 of the print wheels. Guide bar 31 has its opposite ends attached to frame members 10*b* and 10*c*; and the bar passes through a lateral guide bar 38 in the carriage 30. A second guide bar 39 extends parallel to bar 31 and is slidably engaged by the carriage, as in a recess 40, seen in FIG. 3. The carriage is driven left and right in FIG. 4, by a lead screw 42 threadably engaging a nut 43 on the carriage. Screw 42 has its opposite ends rotatably supported at 45 and 46, by members 10*b* and 10*c*; and a drive motor 47 controllably rotates the lead screw to accurately position the carriage and control rotor 25 relative to the print wheels. That is, the toothed pinion 25*a*, which is part of rotor 25, is to be brought into registration with a selected print wheel to be rotated, as seen in FIG. 3.

The mounting means for the control rotor also includes a pusher on the carriage to push or move the control rotor pinion toward a first position (see FIG. 3) of engagement with the periphery of a printing wheel selected for rotation by the control rotor, and away from the selected print wheel periphery to a second position (see FIG. 6) free of disengagement with the periphery to allow control rotor interference free movement parallel to the axis of the printing wheels. See for example the pusher 50 in FIG. 5, connected at 51 to actuator air cylinder 52, as via a piston, and operable to displace the pusher in direction 53. The yoke-shaped pusher has arms 50*a* and 50*b* which in turn carry the splined shaft 54 on which the control rotor is carried, the opposite ends of shaft 54 connected to the pusher arms via block bearings 55 mounted for movement in directions 56', via slots 56*a* in frame members 10*b* and 10*c*. Bearings 55 allow splined shaft rotation to rotatably drive the control rotor 25 and pinion 25*a* thereon. The belt drive-to-shaft 54 allows such shaft movement in direction 56'.

The splined shaft 54 is rotatably driven by a motor 56, via gear 57, timing belt 58 and geared pulley 59, seen in FIGS. 1 and i and mounted as shown. Pulley 59 moves with shaft 54 in directions 56', as seen in FIG. 5. When pinion 25*a* is retracted relative to the selected print wheel 12, as seen in FIG. 6, a stop means in the form of a pin 60 on the carriage is received between pinion gear teeth 61, to positively block rotation of the pinion gear. In this regard, if the gear were rotatable when retracted, the encoder 56*a'* associated with the shaft of drive motor 56 might be erroneously programmed via coupling between 54 and 56.

FIG. 3 shows the pinion 25*a* advanced to a first position of mesh, with teeth 61 meshed with print wheel teeth 19, for rotating the selected print wheel. The pinion has a retracted second position, as seen in FIG. 6, wherein the pinion is captivated against rotation. The air cylinder has a valve solenoid-controlled at 52*a* which is controlled by a master control 100. The latter also controls the drive motors 47 and 56, and may include a programmable computer. See programming keyboard 100*a*, via which a selection of the characters or indicia on the print wheels to be presented for printing can be made or programmed.

Also provided is lock bar means controllably movable axially parallel to the axis of the printing wheels for locking all but the selected printing wheel against rotation. In the illustrated example, (see FIG. 7) the lock bar 70 is elongated in a direction parallel to axis 17, and has an elongated rib or tooth 70*a* which enters the space 19*c* between successive teeth 19 on the print wheels, to prevent their rotation. See FIG. 3. The bar is carried by carriage 30 so that it moves laterally with the control rotor, as the latter moves on splined shaft 54. The lock bar rib 70*a* has a notch 72 presented toward a selected print wheel (to be rotated by rotor 25), for passing the periphery, such as teeth 19, of the selected print wheel 12, i.e. allowing rotation of that wheel by the rotor. See FIG. 7. Thus, all the print wheels are locked against rotation except the selected print wheel. A means is also provided to cause bar 70 to more positively lock the print wheels. As shown in FIG. 8, a fluid pressure actuator 80 mounted on the carriage is operable to forcibly push the lock bar toward the print wheels, i.e., against the sides of teeth 19 forming space 19a, thereby preventing inadvertent rotation of any of the locked wheels as during forcible rotation of the selected wheel by the control rotor. High friction between engaged side faces of the selected wheel and adjacent wheels is thereby prevented from effecting rotation of the adjacent wheels, by slippage of their teeth past the tooth 70a of the lock bar. A return spring 84 acts to urge the lock bar in a direction away from the teeth to break the "lock-up" and allow lateral shifting of the lock bar relative to the print wheels as the carriage is shifted. Actuator 80 includes piston 80a, as shown. An air pressure line to the actuator appears at 85, and a valve, which is solenoid controlled, passes air to the actuator piston.

Also provided is a non-rotatable homing wheel associated with and coaxial with the printing wheels and positioned such that when the control wheel is moved into radial homing alignment with the homing wheel, the lock bar means locks all of the printing wheels against rotation. See for example homing wheel 88 in FIG. 7. When the control rotor pinion is aligned with the homing wheel, the lock bar locks all the print wheels, and the actuator 80 may be operated to effect a tight lock up of all the print wheels, whereby their teeth are then precisely axially aligned, for precision zeroing initialization of the system, via the encoder and master control. The encoders are connected in feedback relation with the master control so that the relative locations of the teeth on the print wheels and on the control rotor are always correctly known at the master control. Accordingly, the locations of the characters on the print wheel teeth are always under control. The encoder for motor 47 is indicated at 47a in FIG. 1.

Finally, means is provided to feed a wire 21 (to be marked) generally parallel to the axis 17 of the print wheels, and into proximity to the peripheries of the print wheels at which printing characters are located. See, for example, the belt drive or drives 90 in FIG. 1 engageable with the wire, and driven by actuator 91. The latter may also be under control of the master control 100.

Additionally, means is provided to feed the print media between the wire and the print wheels. See in FIG. 2 a supply reel 110 for print media strip 22, and take up drum 112 for the media strip. The take up drum may have a knurled shaft 113 engaging a rubber roller 114 to block reverse rotation. A clamping means is operable to displace the wire relative to, i.e., toward, the print wheels to clamp the printing media 22 between the wire and selected characters on the print wheels, thereby to print representations of the presented, i.e., selected characters, on the wheels onto the side of the wire, along its length. See in this regard the actuator 120 in FIG. 2 operable to pivot the body 121 in directions 122, and about a pivot 123. This causes the clamp or anvil 124 to push wire 21 against-media strip 22, pushing the latter against the character 20 on the print wheel tooth 19a, effecting character marking on the wire.

As the body 121 is rocked or pivoted, a mechanism is operated to rotate the media take-up drum 112. See for example links 130 and 131 that rock a crank 132 about a pivot 133; and driver parts 134 and 135 that rotate the take-up drum, an increment each time a printing clamp-up occurs. Thus, fresh (undeformed) print media is continually presented between the wire and the presented print wheel characters.

Retraction springs biasing the body 121 appear at 140 in FIGS. 1 and 2.

I claim:

1. In printing apparatus having a printing head comprising a plurality of coaxial, rotatable printing wheels, disposed substantially side-by-side and employing printing characters, and a control rotor for rotatably controlling the printing wheels and having its axis parallel to that of said printing wheels and positioned to be moved bi-directionally to come into engagement with any selected printing wheel and then to be rotated about its axis to rotate the selected printing wheel for bringing into printing position a desired character thereon, the combination comprising:

a) mounting means mounting said control rotor to
   i) move axially parallel to the axis of the printing wheels,
   ii) move toward and away from the axis of the printing wheels,
   iii) rotate as aforesaid
b) and drive means to effect said i) movement, said ii) movement and said iii) rotation,
c) said mounting means including a carriage for said control rotor, there being a frame mounting the carriage for movement axially parallel to the axis of the printing wheels, said mounting means including structure operable to displace the control rotor toward a first position of engagement with a printing wheel selected for rotation by the control rotor, and away from said selected printing wheel to a second position free of engagement therewith to allow control rotor movement parallel to the axis of the printing wheels,
d) and means associated with the carriage to block rotation of the control rotor in said second position thereof.

2. The combination of claim 1 including lock bar means controllably movable axially parallel to the axis of the printing wheels for locking all but the selected printing wheel against rotation, said lock bar means being carried by said apparatus and being operatively associated with the control rotor.

3. The combination of claim 2 wherein the lock bar means has a notch facing toward the selected printing wheel for passing the periphery of the selected wheel during its rotation by the control rotor.

4. The combination of claim 3 wherein said mounting means also mounts said lock bar means to move simultaneously with said control rotor axially parallel to said axis of the printing wheels.

5. The combination of claim 1 including a wire and a printing media, and means to feed said wire generally parallel to the axis of said printing wheels and into proximity to the peripheries of said printing wheels at which the printing characters are located, means to feed said printing media between said wire and said printing wheels, and clamping means operable to displace said wire relative to said printing wheels to clamp the printing media between the wire and selected characters on the printing wheels, thereby to print representations of said selected characters on the wire.

6. The combination of claim 5 wherein said means to feed the printing media includes a media feed drum, a media take-up drum, and a mechanism for rotating the take-up drum in response to operation of said clamping means.

7. The combination of claim 1 wherein said drive means that effects rotation of the control rotor includes a first motor, and there being a first encoder means associated with said first motor for producing an encoding signal indicative of the rotary position of the control rotor.

8. The combination of claim 7 including control means controlling the drive means including a programmable computer means operatively connected in feedback relative with said first encoder means.

9. The combination of claim 7 wherein said drive means that effects said movement of the control rotor axially parallel to the axis of the printing wheels includes a second motor, and there being a second encoder means associated with said second motor for producing an encoded signal indicative of the axial position of the control rotor relative to said printing wheels.

10. The combination of claim 9 including control means controlling the drive means wherein said control means includes a programmable computer connected in feed-back relative with said first and second encoders.

11. The combination of claim 2 wherein the control rotor is movable axially with the lock bar means, and including a non-rotatable homing wheel associated with and coaxial with said printing wheels and positioned such that when the control rotor is moved axially into a position of radial alignment with the homing wheel, the lock bar means locks all of the printing wheels against rotation.

12. The combination of claim 11 including a frame, and the mounting means including a carriage on and movable relative to the frame for carrying both the control rotor and the lock bar means for movement axially parallel to the axis of the printing wheels.

13. The combination of claim 2 including actuator means for urging the lock bar means into tight lock up with the printing wheels, as during rotation of a selected printing wheel, and means for moving the lock bar means out of said tight lock up to allow its movement axially, as aforesaid.

14. In printing apparatus having a printing head comprising a plurality of coaxial, rotatable printing wheels, disposed substantially side-by-side and employing printing characters, and a control rotor for controlling the printing wheels and having its axis parallel to that of said printing wheels and positioned to be moved bidirectionally to come into engagement with any selected printing wheel and then to be rotated about its axis to rotate the selected printing wheel for bringing into printing position a desired character thereon, the combination comprising:

a) mounting means mounting said control rotor to
   i) move axially parallel to the axis of the printing wheels,
   ii) move toward and away from the axis of the printing wheels,
   iii) rotate as aforesaid
b) and drive means to affect said i) movement, said ii) movement and said iii) rotation,
c) said mounting means including a carriage for said control rotor, there being a frame mounting the carriage for movement axially parallel to the axis of the printing wheels, and said mounting means including a pusher on the carriage to push the control rotor toward a first position of engagement with the periphery of a printing wheel selected for rotation by the control rotor, and away from said selected wheel periphery to a second position free of engagement with said periphery to allow said control rotor movement parallel to the axis of the printing wheels,
d) and including stop means on the carriage to block rotation of the control rotor when the control rotor is in said second position.

15. The combination of claim 14 wherein the printing wheels have peripheral teeth thereon spaced circumferentially about said axis of the printing wheels, said control rotor having teeth thereon spaced circumferentially about said control rotor axis, said control rotor teeth mashing with the teeth on a selected printing wheel during control rotor rotation in its said first position, and said control rotor teeth being out of mesh with teeth on all printing wheels when the control rotor is in its said second position, said stop means extending between successive teeth on the control rotor in said second position thereof.

16. The combination of claim 15 including a non-rotatable homing wheel associated with and coaxial with said printing wheels, and means controlling the drive means that effects rotation of the control rotor to controllably effect its rotation through limited angles in opposite directions after initial movement of the control rotor into said first position thereof, opposite the homing wheel, thereby to accurately position the control rotor teeth relative to the teeth of the homing wheel prior to rotation of the selected printing wheel by the control rotor to position a selected character on the printing wheel for printing.

17. The combination of claim 15 including a fluid pressure responsive drive on the carriage coupled to said control rotor to move it between said first and second position.

18. In printing apparatus having a printing head comprising a plurality of coaxial, rotatable printing wheels, disposed substantially side-by-side and employing printing characters, and a control rotor for controlling the printing wheel sand having its axis parallel to that of said printing wheel sand positioned to be moved bidirectionally to come into engagement with any selected printing wheel and then to be rotated about its axis to rotate the selected printing wheel for bringing into printing position a desired character thereon, there being a wire and printing media, the combination comprising:

a) mounting means mounting said control rotor to
   i) move axially parallel to the axis of the printing wheels,
   ii) move linearly toward and away from the axis of the printing wheels,
   iii) rotate as aforesaid,
b) and drive means to effect said i) movement, said ii) movement and said iii) rotation,
c) said drive means that effects rotation of the control rotor including a first motor, and there being a first encoder means associated with said first motor for producing an encoding signal indicative of the rotary position of the control rotor,
d) said drive means that effects said movement of the control rotor axially parallel to the axis of the printing wheels including a second motor, and there being a second encoder means associated with said second motor for producing an encoded signal indicative of the axial position of the control rotor relative to said printing wheels,
e) and including means to feed said wire generally parallel to the axis of said printing wheels and into proximity to the peripheries of said printing wheels at which the printing characters are located, means to feed said printing media between said wire and said printing wheels, and clamping means operable to displace said wire relative to said printing wheels to clamp the printing media between the wire and selected characters on the printing wheels, thereby to print representations of said selected characters on the wire.

* * * * *